US007182490B2

(12) United States Patent
Hsu

(10) Patent No.: US 7,182,490 B2
(45) Date of Patent: Feb. 27, 2007

(54) STRUCTURE OF ILLUMINATION APPARATUS

(76) Inventor: Huang-Hsi Hsu, 8F., No. 14, Lane 252, Chungshan N. Rd., Sec. 6, Taipei (TW)

( * ) Notice: Subject to any disclaimer, the term of this patent is extended or adjusted under 35 U.S.C. 154(b) by 197 days.

(21) Appl. No.: 10/965,817

(22) Filed: Oct. 18, 2004

(65) Prior Publication Data

US 2006/0082993 A1 Apr. 20, 2006

(51) Int. Cl.
*F21V 21/00* (2006.01)

(52) U.S. Cl. ..... 362/397; 362/396; 362/418

(58) Field of Classification Search ..... 362/35, 362/271, 272, 396, 397, 418
See application file for complete search history.

*Primary Examiner*—John Anthony Ward
(74) *Attorney, Agent, or Firm*—Bacon & Thomas, PLLC

(57) ABSTRACT

The present invention is to provide a structure of an illumination apparatus comprising a sucker mounted in a bottom of a base thereof to provide the base with an adsorptive power. A power supply housing is extended upwardly on a central top portion of the base, wherein a power supply part is mounted in the power supply housing for providing with the electric power and a switch is mounted on the outside of the power supply housing so as to turn on or turn off the electric power provided by the power supply part. An adjustable device is mounted on a top of the power supply housing, wherein a housing is mounted on one end of the adjustable device and a light emitting device is mounted in the housing so as to twist the adjustable device to provide with the purpose of multi-angle adjustments.

8 Claims, 4 Drawing Sheets

STRUCTURE OF ILLUMINATION APPARATUS

BACKGROUND OF THE INVENTION

1. Field of the Invention

The present invention relates to a structure of an illumination apparatus, more particularly to the structure of the illumination apparatus having a sucker mounted in a bottom of a base thereof to provide the base with an adsorptive power, enabling the illumination apparatus to be firmly attached on any position through the sucker on the bottom of the illumination apparatus.

2. Prior Art

Today's life cannot be labeled as so-called "modern life" if there are no illumination of the electric lamp. With the progress of the technology, the illumination apparatus is focused not only on the targets of "more brightness" and "more economy" but also on the purpose of "comfort" and "convenience". We cannot avoid the dark night since the earth orbits the sun again and again. However, the illumination apparatus make people be able to overcome the hedge of nature, such that we can keep acting in the dark night because the illumination apparatus illuminates the dark place for us. The illumination requirement of the user is satisfied through supplying the electric power for the illumination apparatus. Consequentially, for people the more progress of the illumination apparatus the more relying on it.

However, since there are various designs for commercial illumination apparatus, an exemplary flashlight that is not new to people is illustrated. As shown in FIG. 1, the flashlight 1 comprises a tube-shaped body 10 inside which a power supply part 11 is mounted for supplying the electric power for the flashlight 1. The power supply part 11 is designed to be composed of at least one battery 111 or a charging device, for example, a charger.

In addition, a switch 12 is mounted on the outside of the tube-shaped body 10 to turn on or turn off the power supply part 11. Moreover, a housing 13 is mounted on the front end of the tube-shaped body 10. A light emitting device 14 is mounted within the housing 13. When the user turns on the switch 12, the flashlight 1 will be electrified to enable the light emitting device 14 to emit light and to satisfy the requirement for illumination. In addition, the light emitting device 14 can be an electronic device that is equipped with a tungsten lamp or a light emitting diode (LED).

However, the utilization of aforementioned conventional illumination apparatus, for example, the flashlight 1, has drawbacks, namely, the flashlight 1 cannot attached firmly on any position, for example, a sidewall. Therefore, the utilization of the flashlight 1 is restricted and the illumination requirement of the user cannot be satisfied. Accordingly, the design of the conventional illumination apparatus is simple and has no practicability. It is perplexed and inconvenient for the user to use thereof, and needed to be improved. Besides, the market competitions between manufacturers of manufacturing and designing the illumination apparatuses are violent. If the practicability of one manufacturer's product cannot catch up with that of other manufacturers' products, this product will be eliminated through competition during the tempestuous fashion tide.

SUMMARY OF THE INVENTION

Because the conventional structure of the illumination apparatus cannot be attached firmly on a random sidewall when the user tries to fix the illumination apparatus thereon, it cannot satisfy the illumination requirement at a special environment and the greatest benefit will not be obtained. Moreover, it is confusing and inconvenient for the user to use. Accordingly, in order to solve the above problems, the inventor has been-made sustained researches and experiments to finally develop "structure of illumination apparatus" of the present invention in accordance with inventor's experience accumulated in the skill.

One aspect of the present invention is to provide a structure of an illumination apparatus to effectively solve the conventional drawbacks of being unable to be positioned firmly due to its limited mounting position. In the structure of the illumination apparatus, a sucker is mounted in a bottom of a base to provide the base with an adsorptive power. A power supply housing is extended upwardly on a central top portion of the base, wherein a power supply part is mounted in the power supply housing for providing with the electric power and a switch is mounted on the outside of the power supply housing so as to turn on or turn off the electric power provided by the power supply part. An adjustable device is mounted on a top of the power supply housing, wherein a housing is mounted on one end of the adjustable device and a light emitting device is mounted in the housing so as to twist the adjustable device to provide the purpose of multi-angle adjustments. Thus, the illumination apparatus can be attached on any position, such as a sidewall, through the sucker on the bottom of the illumination apparatus.

Another aspect of present invention is to provide an illumination apparatus which cooperates with a clamping member for positioning the illumination apparatus. In the clamping member, a clamping base having openings on its three sides is composed of a top plate and a bottom plate mounted in parallel and spaced in a predetermined distance, and a connection plate connected to one side of the top plate and the bottom plate respectively. A movable clamping plate is mounted in the openings of the clamping base and on the bottom plate, wherein an adjusting shaft is mounted below the clamping plate and penetrated through the bottom plate such that the clamping plate can be moved upward or downward by rotating the adjusting shaft so as to achieve the purpose of clamping a fixed subject firmly through the clamping plate and the top plate, and the sucker on the bottom of the illumination apparatus is therefore attached tightly on a surface of the top plate. Accordingly, the greatest benefit of the illumination apparatus will be obtained.

DETAILED DESCRIPTION OF THE PREFERRED EMBODIMENT

Figure 1:
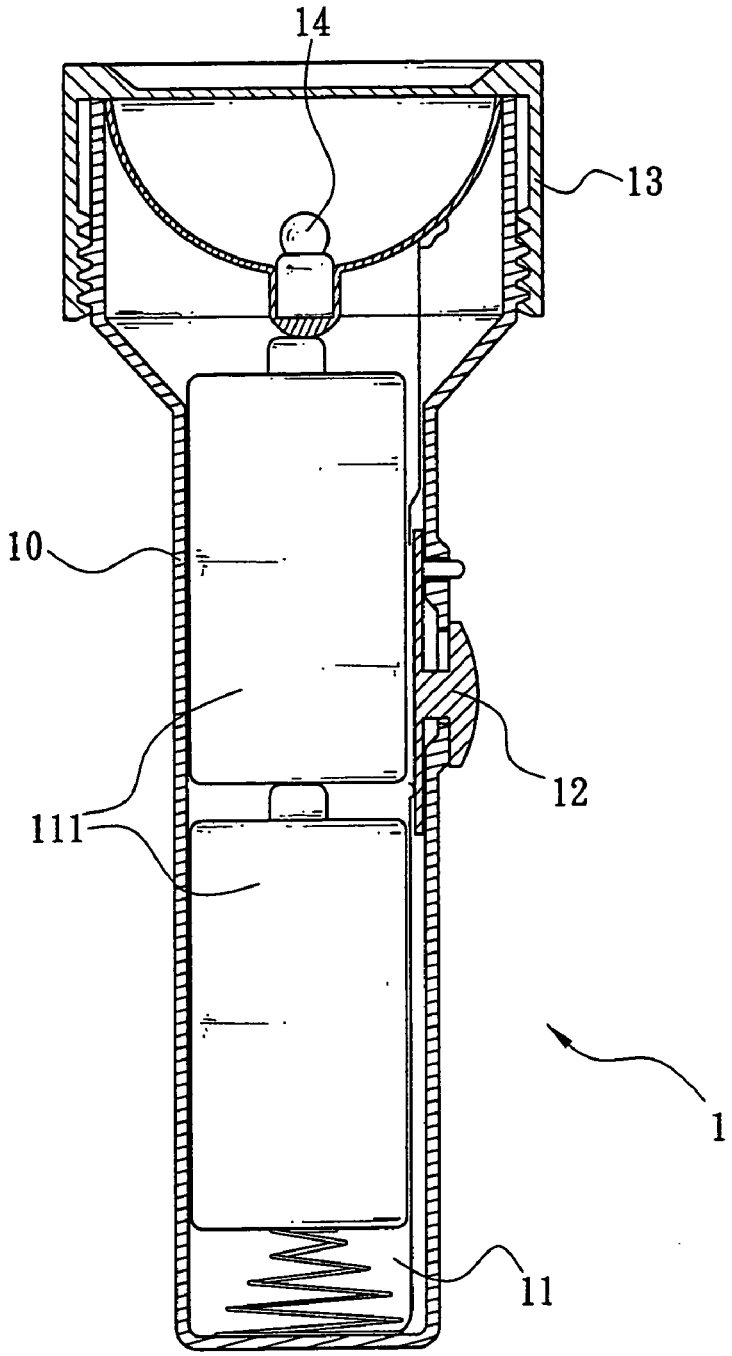
FIG. 1 (Prior Art)
FIG. 1 is an outward appearance of the convention illumination apparatus.
Figure 2:
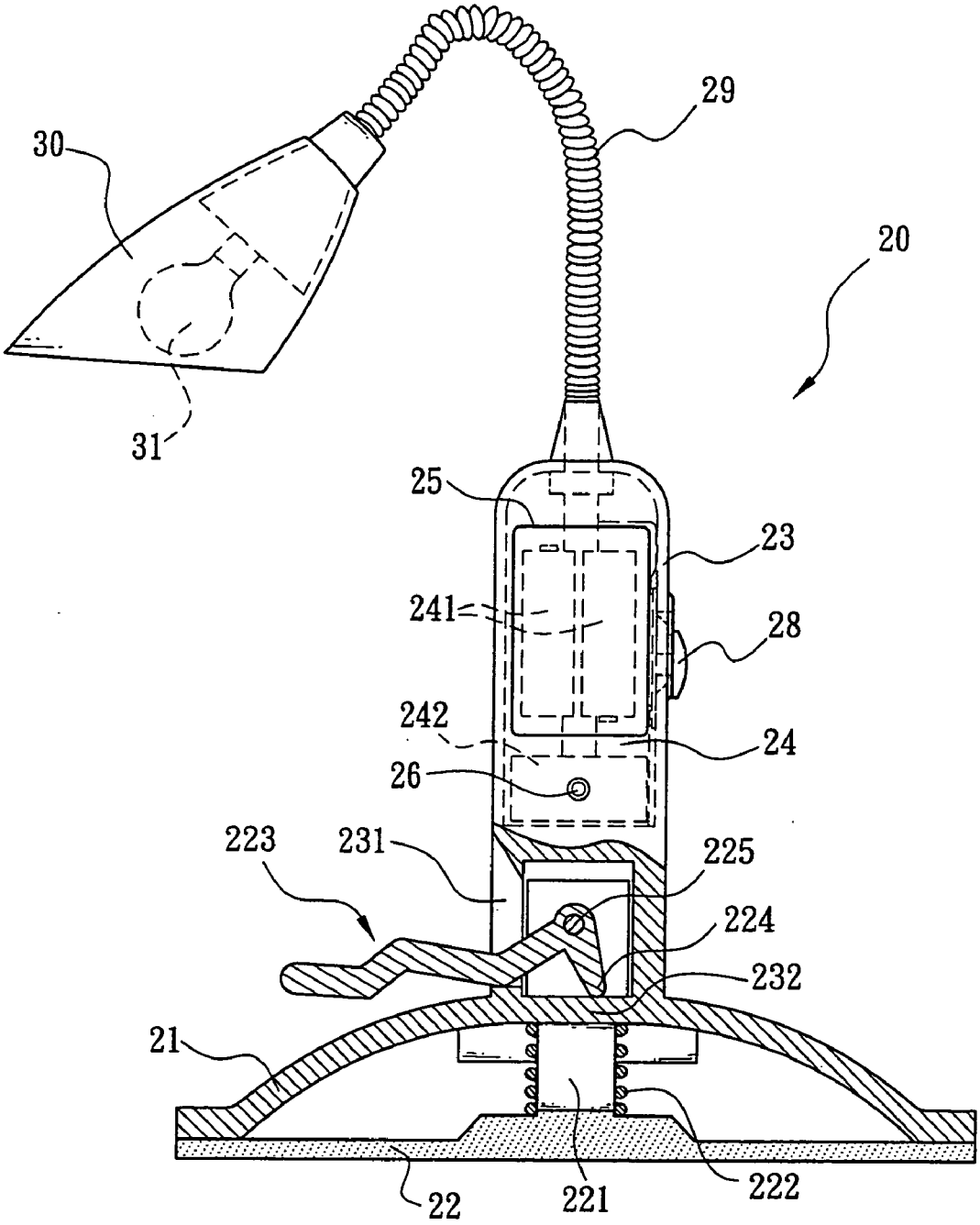
FIG. 2 is a cross-sectional, partial view showing the present invention.

The present invention is a structure of an illumination apparatus. Referring to FIG. 2, the illumination apparatus 20 on which a base 21 is mounted is provided, wherein a bottom of the base 21 is hollow so as to exactly receive a sucker 22 to provide the base 21 with an adsorptive power. A power supply housing 23 within which a power supply part 24 is mounted is extended upwardly on the central top portion of the base 21, wherein the power supply part 24 can be used to supply the illumination apparatus 20 with the electric power required for illumination.

Figure 4:
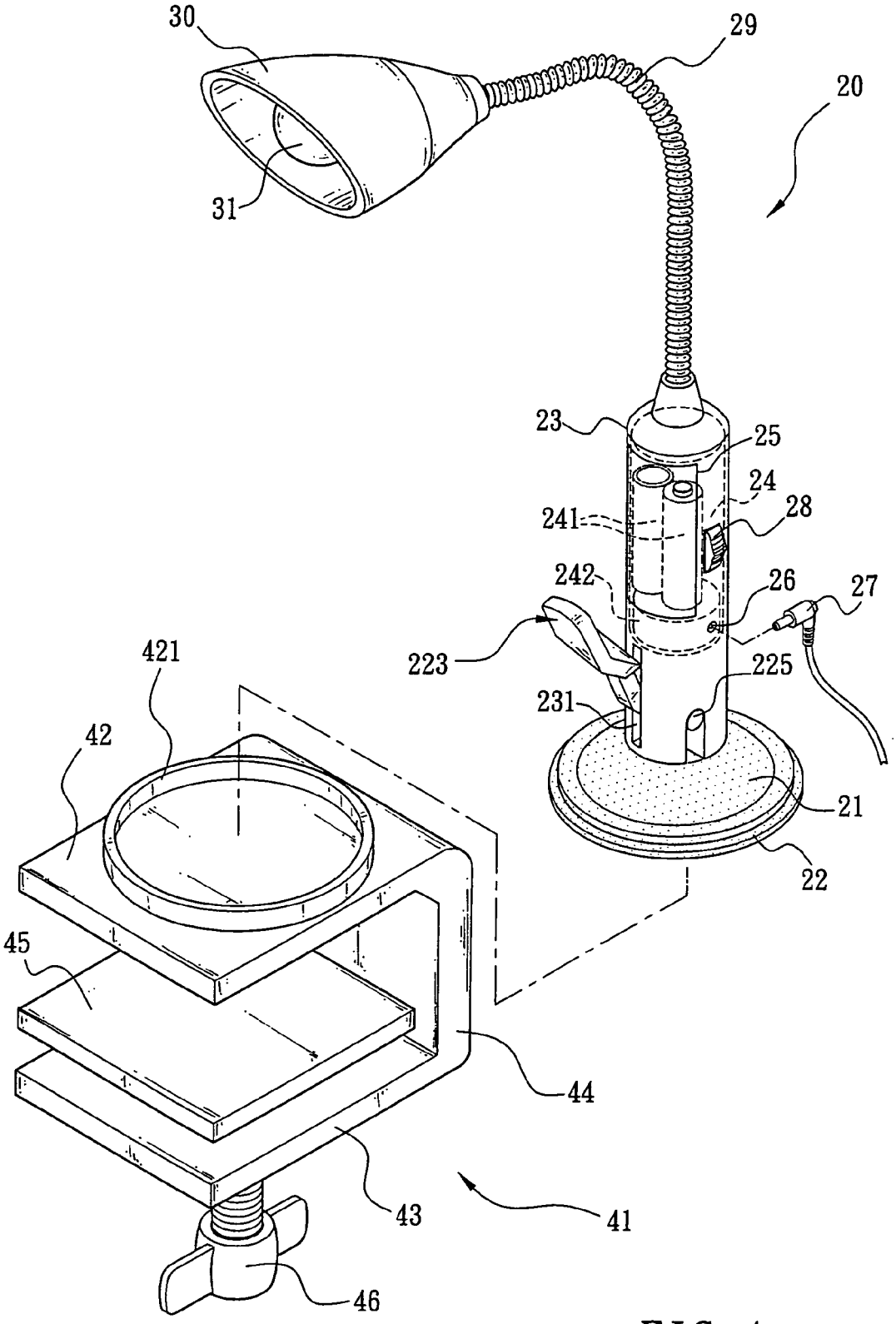
FIG. 4 is schematic diagram showing the use of the present invention together with a clamping member.

In the present invention, the power supply part 24 can be designed to be composed of at least one battery 241. The battery 241 can be mounted into the power supply part 24, and then covered by a cover 25 mounted on an outer sidewall of the power supply housing 23. Optionally, the power supply part 24 can be designed to be composed of an AC/DC adapter, wherein the external electric power can be conducted into the power supply part 24 by inserting a plug 27 into a socket 26 mounted on the outer sidewall of the power supply housing 23 (as shown in FIG. 4). Optionally, the power supply part 24 can be designed to be composed of a charging device 242, for example, a charger.

Referring to FIG. 2 again, a switch 28 is mounted on the outside of the power supply housing 23 to turn on or turn off the power supply part 24. In addition, an adjustable device is mounted on the top of the power supply housing 23, in the FIG. 2, the adjustable device is a flexible pipe 29 covered with a metal serpentine pipe on its outside. A housing 30 is mounted on one end of the flexible pipe 29. A light emitting device 31 is mounted in the housing 30, thus the user is able to twist the flexible pipe 29 to provide the purpose of multi-angle adjustments. After the switch 28 is turned on, the illumination apparatus is electrified to actuate the light emitting device 31 so as to achieve the purpose of illumination. In addition, the light emitting device 31 can be an electronic device that is equipped with a tungsten lamp or a light emitting diode (LED).

Referring to FIG. 2 again, a penetrating hole 231 is mounted on an extension position of the base 21 with respect to the power supply housing 23. A block shaft 232 is mounted on the bottom of the penetrating hole 231. A pillar 221 having a slot on its central portion is extended upwardly on the central portion of the sucker 22 such that the sucker 22 can penetrate the block shaft 232 to be fitted within the bottom of the power supply housing 23 and the base 21. A spring 222 is mounted on the outside of the pillar 221. In addition, a push member 223 is provided, wherein a head 224 of the push member 223 penetrates the block shaft 232 of the penetrating hole 231 and is pivotally mounted in the slot of the pillar 221 through a pin 225. Accordingly, when the exposed end of the push member 223 is pressed down, the head 224 of the push member 223 can be forced against the block shaft 232 so as to press down the spring 222, and a vacuum status is produced when the bottom of the base 21 presses down the sucker 22 so as to adsorb each other. Due to the vacuum status of the bottom of the base 21, the sucker 22 will be drawn back so as to adsorb tightly on a fixed subject. On the other hands, when the exposed end of the push member 223 is pulled up, the head 224 of the push member 223 will not be forced to against the block shaft 232 any more. Therefore, the bottom of the base 21 will be pushed up by the springiness of the spring 222 to remove the adsorption between the sucker 22 and the bottom of the base 21. Thus, the illumination apparatus 20 can be demounted readily.

Figure 3:
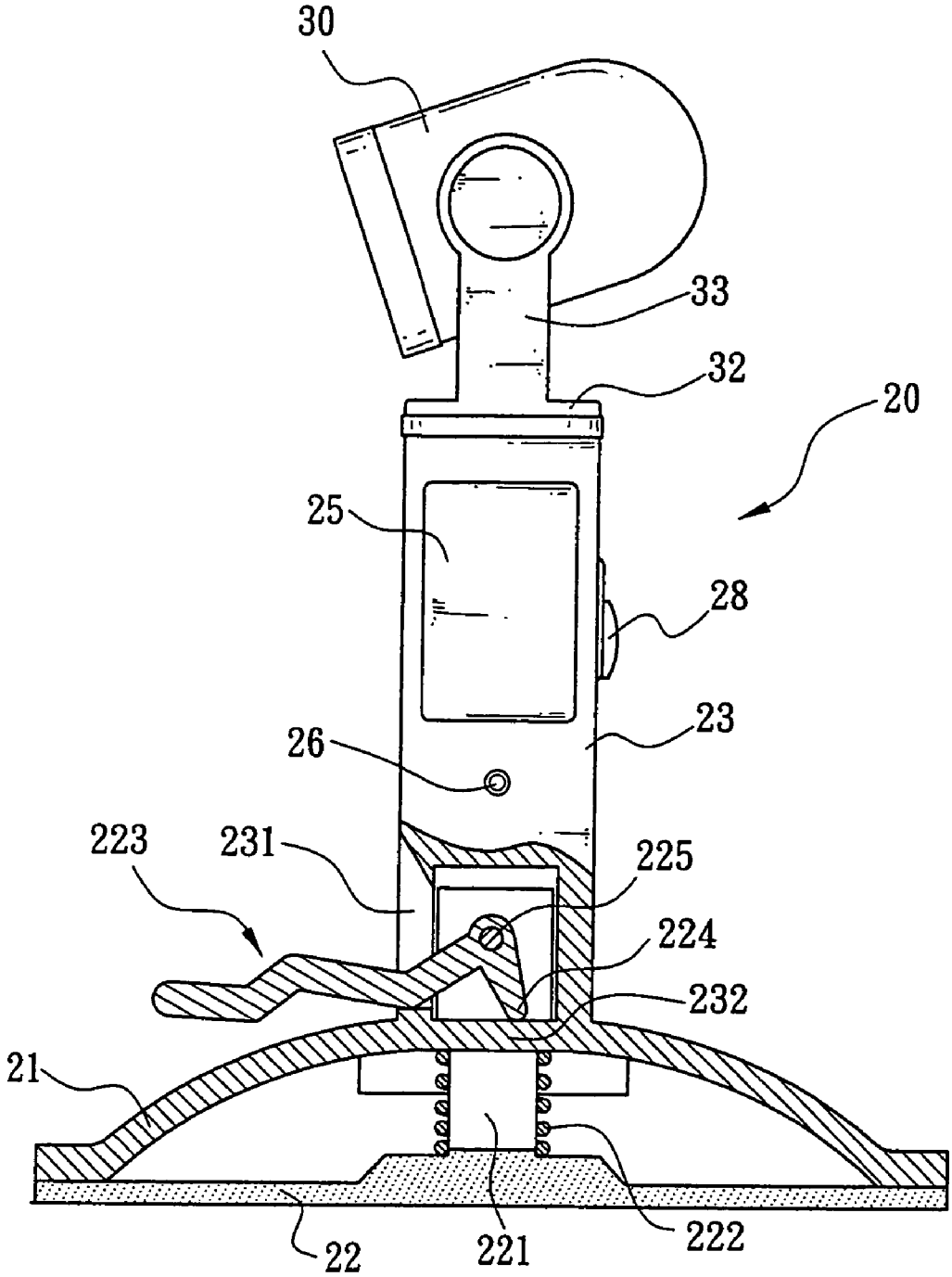
FIG. 3 is a schematic diagram showing the adjustable device according to another preferred embodiment of the present invention.

In the present invention, as shown in FIG. 3, the adjustable device can be a rotator 32, one end of the rotator 32 is pivotally mounted on the power supply housing 23, the other end of the rotator 32 includes two arms 33 spaced in a predetermined distance. The housing 30 is pivotally mounted between these two arms 33. Thus, for the user, the purpose of multi-angle adjustments can be achieved by rotating the position of the rotator 32 and adjusting the position of the housing 30.

In the present invention, as shown in FIG. 4, the illumination apparatus 20 may be cooperate with a clamping member for positioning the clamping member. A clamping base 41 having openings on its three sides is composed of a top plate 42 and a bottom plate 43 mounted in parallel and spaced in a predetermined distance, and a connection plate 44 connected to one side of the top plate 42 and the bottom plate 43 respectively. A movable clamping plate 45 is mounted in the openings of the clamping base 41 and on the bottom plate 43. An adjusting shaft 46 is mounted below the clamping plate 45 and penetrated the bottom plate 43. Accordingly, the clamping base 41 can be used to receive a fixed subject to be mounted thereon through the openings on its three sides. The clamping plate 45 can be moved upward or downward by rotating the adjusting shaft 46 so as to achieve the purpose of clamping the fixed subject firmly through the clamping plate 45 and the top plate 42. Thus, the sucker 22 on the bottom of the illumination apparatus 20 can be attached tightly on a surface of the top plate 42.

In addition, in order to prevent an outer edge of the sucker 22 from peeling off due to external force when the sucker 22 mounted on the bottom of the illumination apparatus 20 is mounted on the surface of the top plate 42, a flange 421 for exactly receiving the sucker 22 can be mounted on the top plate 42 to protect the sucker 22 from peeling off.

By using the aforementioned members, the user is able to attach the illumination apparatus 20 on any position, such as a sidewall, through the sucker 22 on the bottom of the illumination apparatus 20. Furthermore, the greatest benefit will be obtained by using the clamping member to solve the conventional drawbacks of lacking practicability and convenience for the use of the user due to its limited mounting position.

The invention claimed is:

1. A structure of an illumination apparatus comprising:

a base having a hollow shape bottom for exactly receiving a sucker so as to provide the base with an adsorptive power;

a power supply housing extended upwardly on a central top portion of the base, wherein a power supply part is mounted in the power supply housing for providing with the electric power and a switch is mounted on the outside of the power supply housing so as to turn on or turn off the electric power provided by the power supply part; and an adjustable device mounted on a top of the power supply housing, where in a housing is mounted on one end of the adjustable device and a light emitting device is mounted in the housing so as to twist the adjustable device to provide multi-angle adjustments, wherein the illumination apparatus arranged to cooperate with a clamping member for positioning the illumination apparatus, the clamping member comprising:

a clamping base having openings on its three sides, wherein the clamping base is composed of a top plate and a bottom plate mounted in parallel and spaced at a predetermined distance, and a connection plate is connected to one side of the top plate and the bottom plate respectively: and a movable clamping plate mounted in the openings of the clamping base and on the bottom plate, wherein an adjusting shaft is mounted below the clamping plate and penetrates through the bottom plate such that the clamping plate can be moved upward or downward by rotating the adjusting shaft so as to clamp a fixed object firmly through the clamping plate and the top plate, the sucker on the bottom of the illumination apparatus being attached tightly on a surface of the top plate.

2. The structure of an illumination apparatus of claim 1 wherein the power supply part is composed of at least one battery and covered by a cover mounted on an outer wall of the power supply housing.

3. The structure of an illumination apparatus of claim 1 wherein the power supply part is composed of an AC/DC adapter, wherein the external electric power can be guided into the power supply part by inserting a plug into a socket mounted on an outer sidewall of the power supply housing.

4. The structure of an illumination apparatus of claim 1 wherein the power supply part is composed of a charging device.

5. The structure of an illumination apparatus of claim 1 wherein the adjustable device is a flexible pipe covered with a metal serpentine pipe on its outside.

6. The structure of an illumination apparatus of claim 1 wherein a penetrating hole is mounted on an extension position of the base with respect to the power supply housing, a block shaft is mounted on the bottom of the penetrating hole, a pillar having a slot on its central portion is extended upwardly on a center portion of the sucker such that the sucker can penetrate the block shaft to be fitted within a bottom of the power supply housing and the base, a spring is mounted on an outside of the pillar, and a push member is provided, wherein a head of the push member penetrates through the block shaft of the penetrating hole and pivotally mounted in the slot of the pillar through a pin.

7. The structure of an illumination apparatus of claim 1 wherein the adjustable device is a rotator, and one end of the rotator is pivotally mounted on the power supply housing, the other end of the rotator comprises two arms spaced in a predetermined distance to pivotally mount the housing between these two arms.

8. The structure of an illumination apparatus of claim 1 wherein a flange for exactly receiving the sucker is mounted on the top plate to protect the sucker from peeling off due to an external force.

* * * * *